US006683540B1

(12) United States Patent
Harrison

(10) Patent No.: US 6,683,540 B1
(45) **Date of Patent: *Jan. 27, 2004**

(54) RAILROAD CROSSING SIGNAL APPARATUS

(76) Inventor: Michael A. Harrison, 2292 Airport Blvd., Santa Rosa, CA (US) 95490

( * ) Notice: Subject to any disclaimer, the term of this patent is extended or adjusted under 35 U.S.C. 154(b) by 0 days.

This patent is subject to a terminal disclaimer.

(21) Appl. No.: 10/141,198

(22) Filed: May 7, 2002

Related U.S. Application Data

(63) Continuation-in-part of application No. 09/649,639, filed on Aug. 28, 2000, now Pat. No. 6,384,742, which is a continuation-in-part of application No. 09/039,877, filed on Mar. 16, 1998, now abandoned, which is a continuation-in-part of application No. 08/680,275, filed on Jul. 11, 1996, now abandoned, which is a continuation-in-part of application No. 08/257,334, filed on Jun. 8, 1994, now abandoned.

(51) Int. Cl.[7] ..... G08G 1/095

(52) U.S. Cl. ..... 340/944; 340/917; 340/908.1; 340/925; 116/63 R

(58) Field of Search ..... 340/944, 907, 340/917, 908.1, 925; 238/8; 116/63 R

(56) References Cited

U.S. PATENT DOCUMENTS 5,412,381 A * 5/1995 Dick ..... 340/908.1
6,259,375 B1 * 7/2001 Andras ..... 340/907

* cited by examiner

*Primary Examiner*—Daryl Pope
(74) *Attorney, Agent, or Firm*—Larry D. Johnson; Craig M. Stainbrook; Johnson & Stainbrook, LLP

(57) ABSTRACT

A traffic warning system which alerts approaching vehicle traffic to the approach of a train in a crossing. The system includes a plurality of surface mounted lights partially embedded in and placed across a roadway. Once activated, the flashing lights warn drivers of approaching vehicles that the train is approaching, and that caution should be exercised.

10 Claims, 2 Drawing Sheets

RAILROAD CROSSING SIGNAL APPARATUS

CROSS REFERENCE TO RELATED APPLICATIONS

This application is a continuation-in-part of application Ser. No. 09/649,639, filed Aug. 28, 2000, now U.S. Pat. No. 6,384,742, issued May 7, 2002, which was a continuation-in-part of co-pending application Ser. No. 09/039,877, filed Mar. 16, 1998, and now abandoned, which was a continuation-in-part of application Ser. No. 08/680,275, filed Jul. 11, 1996, and now abandoned, which was a continuation-in-part of application Ser. No. 08/257,334, filed Jun. 8, 1994, and now abandoned.

BACKGROUND OF THE INVENTION

STATEMENT REGARDING FEDERALLY SPONSORED RESEARCH OR DEVELOPMENT

Not applicable.

REFERENCE TO A MICROFICHE APPENDIX

Not applicable.

1. Field of the Invention

This invention relates generally to lighting and signal warning devices, and more specifically to an improved railroad crossing signal apparatus.

2. Discussion of the Related Art

Current railroad crossing designations can be inadequate for many locations and lighting conditions. For example, stripes painted on the surface of the pavement are difficult to see even under optimum circumstances, and railroad crossing caution signs can be lost in the background clutter of trees, business signs, buildings, temporarily parked delivery trucks and vans, and the like. Traffic signals and mechanical gates are useful to help designate railroad crossing locations, but these can be extremely expensive to install and maintain and, therefore, are reserved for only the busiest locations.

BRIEF SUMMARY OF THE INVENTION

The railroad crossing signal apparatus of this invention provides an improved signal device for currently non-signaled railroad crossings, or as an enhancement to currently signaled crossings. One or more selectively illuminated devices are affixed or embedded in the roadway parallel to railroad tracks where such tracks cross the roadway at grade, and are designed to be activated by the approach of a train. When activated, these devices are illuminated in either flashing or steady red, amber, or other color, in order to alert motorists to the approach of a train. Separate, advance warning devices may be located some distance from the crossing, flashing in amber or other suitable color, as an early warning that the motorist is approaching a railroad crossing. This array of devices may be used in conjunction with existing or other warning devices, or as a stand-alone system, for the purpose of creating a psychological barrier to motorists.

The railroad crossing signal apparatus of this invention thus provides a low-cost traffic warning system which is self-contained, easily retrofitted to existing railroad crossing locations and designed to alert approaching vehicle traffic to the presence of a train in a crossing. The inventive system includes a plurality of above-pavement, surface mounted lights, installed in a fashion similar to currently used road reflectors, and which are partially embedded in a roadway and placed across the roadway, e.g., adjacent to and parallel with the existing stripes designating a crossing, and constructed so that they are impervious to vehicle traffic over them. The lights are activated by the approach of a train, in any of a variety of manners known in the art. Once activated, the lights flash in the direction of oncoming traffic, and emanate directly from the roadway, to warn drivers of approaching vehicles that a train is approaching, and that caution should be exercised.

The warning lights may be installed facing only the oncoming traffic, or across the entire length of the crossing, or in any other manner. When actuated, the system can flash the lights in a sequence to be determined, warning oncoming traffic of the train. The lights will remain flashing until the train has safely exited the crossing.

The level of illumination can be designed to conform with existing illumination standards for traffic control devices and further modified for either daytime or nighttime use. An ambient light sensing circuit may be provided to adjust light intensity to dynamically compensate for poor visibility and night operating conditions.

The inventive apparatus can include data storage circuitry to collect additional data such as the number of trains activating the apparatus, and the number of vehicles approaching or passing over the apparatus by time of day. The inventive system may include report generation capability which can be useful in determining how frequently the crossing is used and the heavy or light usage time periods. These capabilities can be expanded to include other data which the system owner may find useful in preparing future strategies.

The inventive system can be installed virtually anywhere standard railroad crossing markings are deemed to be ineffective, or where the installation problems of high cost traffic signals or mechanical gates are impractical. The use of surface mounted lights afford minimal impact to the existing roadway or surface, which keeps installation simple and cost effective.

The inventive system can be conventionally powered (e.g., from existing overhead or underground power lines) or solar powered for stand-alone applications. For example, the lighting system may be powered by a twelve volt power source consisting of a solar panel, maintenance free battery and a charging circuit. The system may utilize proven solar technology to allow stand alone operation, thus eliminating the need for existing electrical power at the installation site. A pole mounted solar panel provides all the necessary power for operating the system while a maintenance free battery provides backup power during night or low light conditions. The solar panel can be sized to ensure adequate current to power the lighting system while charging the maintenance free battery during daylight hours. The maintenance free battery can be sized to ensure adequate reserve current to power the lighting system during night time hours when the solar panel is not in operation.

A main control unit consisting of a single board computer can be provided to control all operation of the lighting system. The main control unit may perform the following functions:

- scan the switches for input requiring the system to be activated;
- adjust the brightness of the lighting system;
- deactivate the lighting system after a preset time has expired, placing the system in stand-by mode;
- monitor the condition of the maintenance free battery and charging system;

monitor all parameters of the lighting system for fault detection; and maintain a log of times and frequency of activations for report generating.

Additional safety features can be added to expand the capabilities of the system, allowing an increased level of security. These features can be installed with the basic system or added to the system as future expansion requires. For example:

Remote Control

The inventive system may be capable of being controlled remotely by the addition of a communications module. This feature would allow the system to be turned on or off and monitored for general faults by use of either radio or cellular communication. This ability may be useful in cases where the system is used in other applications. In such cases the system could be switched on by the appropriately designated agency (e.g., police, fire, public works, etc.) by a handheld device, from within a passing vehicle, or by long range signaling from a central location when conditions warrant.

Vehicle Signal

A further option would be to install a system by which a signal would be broadcast when the railroad crossing signal apparatus was activated and which would be received by a device installed in a vehicle (retrofit to the vehicle, or eventually factory installed) to audibly and/or visually alert the driver of the vehicle that a train has activated the system. This could more easily alert the driver to the presence of a train.

DETAILED DESCRIPTION OF A PREFERRED EMBODIMENT

Figure 1:
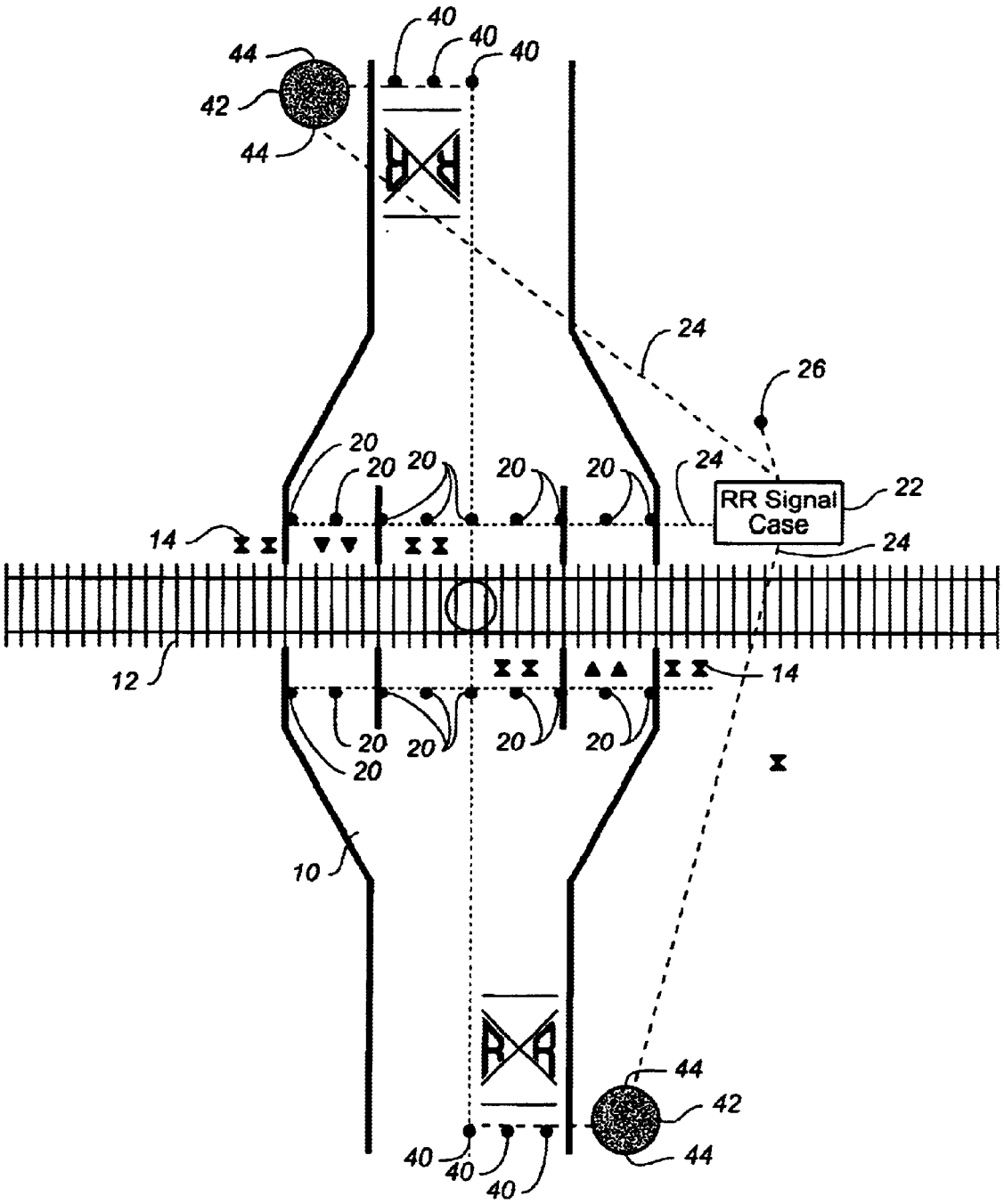
FIG. 1 is a top plan view of a railroad crossing signal apparatus of this invention as installed in a typical location, illustrating a plurality of light devices embedded in the roadway, and a pair of railroad warning signs mounted on poles on each side of the roadway.

FIG. 1 is a top plan view of a railroad crossing signal apparatus of this invention. The apparatus is preferably installed in a roadway 10 adjacent railroad tracks 12 where the tracks cross the roadway at or near grade. The apparatus may be utilized at currently non-signaled railroad crossings, or to enhance a crossing having existing railroad signals 14 such as pole or overhead-mounted crossing lights or mechanical gates. The inventive apparatus preferably includes a plurality of signal head members 20 mounted on the roadway surface and extending at least some distance across the roadway 10 and above the roadway surface to at least partially designate a railroad crossing. Each of the signal head members 20 are conditioned to withstand contact by vehicle traffic. Each of the signal head members 20 include at least one light source adapted to direct a beam of light from the roadway surface in the direction of the approaching vehicle traffic and away from the railroad crossing, and adjacent to and generally parallel to the roadway surface.

Activation of these signal heads can be accomplished by railroad signal controller 22, via cables 24, in the same manner that existing railroad signals 14 are activated, that is, by the approach of a train. Power can be suppled to the system from power pole 26, solar panels, batteries, or other sources.

One or more separate, advance devices may also be utilized, such as one or a plurality of advance signal head members 40 installed in the roadway 10 some distance (e.g., 500–1,000 feet) prior to the crossing. These advance devices preferably flash in amber or other suitable color as an early warning. Pole-mounted railroad crossing signs 42 may enhanced by incorporation of LED modules 44, powered and controlled in the same manner.

Figure 2:
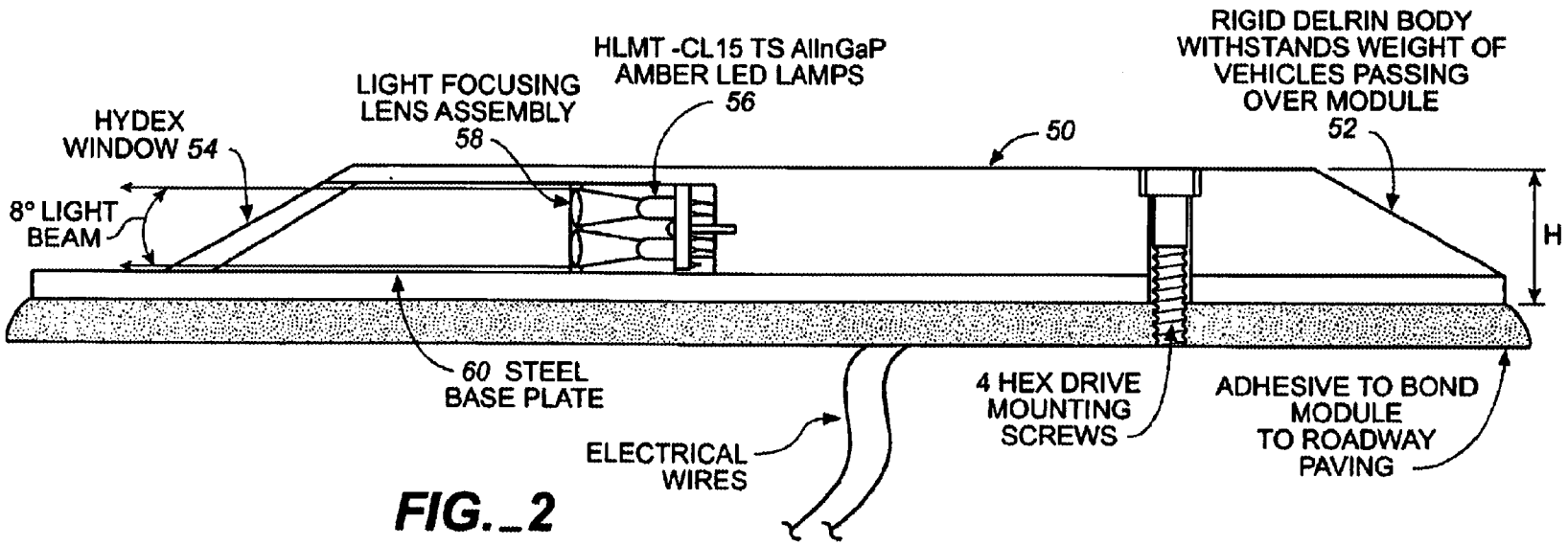
FIG. 2 is a simplified cross-sectional diagram of a light module of this invention.

FIG. 2 is a simplified cross-sectional diagram of an LED (light emitting diode) light module or signalhead 50 of this invention. Durable delrin construction of the module housing 52 withstands the weight of heavy vehicles in passing traffic. The window 54 is of highly abrasion and weather-resistant hydex. Mounted on a small PC board on the inside are the LED lamps 56. Light from the LEDs passes through a lens assembly 58 that focuses the light into a desired beam in the direction of an approaching vehicle, e.g., eight degrees vertical, fourteen degrees horizontal. The modules may have no active LED drive electronics.

The inventive signal head may consist of individual housings containing light emitting diodes which are specifically focused or "aimed" in the direction of oncoming traffic for a pre-determined viewing distance to the driver of an approaching vehicle for maximum effectiveness. The signal head may contain a specifically designed lens for increasing daytime visibility. The signal head may be designed with forward "window" flush surface for self cleaning by auto tires as they cross the face of the signal head occasionally.

The signalhead 50 should preferably have an above-pavement height H of approximately ½ to ¾ inches. While minimal, this physical height (or any other practical height) permits positioning of the light source (e.g., LED lamps 56) above the road surface, enabling the light beam to be directed generally parallel to the road surface (e.g., a vertical angular range of 0 degrees to preferably at least 6 degrees, with a preferable maximum of approximately 15 degrees). This above-pavement, parallel-to-pavement configuration permits the lights to be perceived at a great distance down the roadway, by an observer at a typical height slightly above the roadway surface (i.e., at a range of heights of the eyes of typical drivers seated in typical vehicles driving towards the pedestrian crosswalk). Flush-mounted lights would not provide such visibility.

The surface mounted base plate assembly 60 is specifically designed for road mounting to withstand the harsh environment and resistance to detachment from the road surface and easy mounting of the signal head into position. This base plate also allows for the occasional removal and maintenance of the signal head in minimal time. Alternatively, the base plate may extend into the roadway, to any appropriate depth for secure anchoring (e.g., 2½ inches).

The system may include a solar powered or conventionally a/c powered controller which automatically senses ambient light and selects the correct power to the signal heads for viewing effectiveness. The controller may be on demand activated and adjustable for each site specific location. Also, the controller may provide counts and other data base functions for purposes of collection and system use and operation.

The controller may be based on a single board embedded computer, custom microcontroller system, or programmable logic controller (PLC). Optically isolated inputs and outputs may provide monitoring and control of the system.

A 4×20 character LCD display, used in conjunction with a 4×4 matrix keyboard allows an operator to easily modify the programmable settings following a simple menu system.

Analog inputs are provided to allow connection to sensors for monitoring ambient light conditions, solar panel condition, battery charge activity and power supply condition. Ambient light is continuously monitored and the lights are dynamically adjusted to provide the optimum brightness based on current lighting conditions.

Data logging capability is built into the system to allow archiving critical information for historical trending at a later date.

Information which could be useful in analyzing system performance and system usage is written to a removable floppy disk which can be read by a spread sheet program on a host computer for purposes of trending and report generation.

Each time the system is activated, the date and time may be logged to a file for historical purposes. This could be useful in cases where liability is an issue. For example, if the system is installed at a railroad crossing and a car is hit by a train, the rail road company could produce a report showing the system was activated at the time of the accident and the driver ignored the warning.

Remote Sensing

A sensor could be built into new cars by the manufacturer where an audible or visual signal would announce to the driver that a train is approaching. The system controller would broadcast via a low power radio or other signal to activate the sensors within a predetermined range so only the vehicles at or near the crossing would be affected.

Remote Control Link

The controller can be accessed remotely via radio or telephone from a central computer. This could be useful in uploading new parameters to the controller, downloading historical files from the controller or remotely activating the system without actually having to be at the site.

Further alternatives include a flexible wiring buss which would be laid across the road and covered by a thick stripping material. The LED lamp assemblies would be attached to the stripe by adhesive and the connections made to the buss by conventional means or by one or more spikes which would penetrate the buss when the lamp is pressed onto the stripe. This method would ease installation and eliminate the need to cut the street.

Alternatively, light pipes similar in design to fiber optic cable could be embedded into the striping material. A laser coupled into one end of the light pipe could be the light source which would be carried down the light pipes and be emitted at pre-determined locations along the stripe.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. A railroad crossing signal apparatus to alert approaching vehicle traffic to the approach of a train in a crossing, said railroad crossing signal apparatus comprising:

a roadway, said roadway having a surface;

a plurality of signal head members mounted on said roadway surface and extending at least some distance across said roadway and above said roadway surface to at least partially designate a railroad crossing, each of said signal head members conditioned to withstand contact by vehicle traffic, each of said signal head members including at least one light source adapted to direct a beam of light from said roadway surface in the direction of the approaching vehicle traffic and away from the railroad crossing, and adjacent to and generally parallel to said roadway surface; and activation means to selectively illuminate said plurality of signal head members light sources to warn the drivers of the approaching vehicles that a train is approaching the crossing.

2. The railroad crossing signal apparatus of claim 1 including an ambient light sensing circuit to adjust light intensity to dynamically compensate for poor visibility and night operating conditions.

3. The railroad crossing signal apparatus of claim 1 wherein said signal head members have a height of ½ to ¾ inches above said roadway surface.

4. The railroad crossing signal apparatus of claim 1 wherein said signal head light source comprises light emitting diodes.

5. The railroad crossing signal apparatus of claim 1 wherein said signal head light source is directed in a beam having a vertical angular range of 0 degrees to 5 degrees.

6. The railroad crossing signal apparatus of claim 1 wherein said signal head members are installed facing only oncoming vehicle traffic.

7. The railroad crossing signal apparatus of claim 1 wherein said signal head members are installed across the entire width of a crossing.

8. The railroad crossing signal apparatus of claim 1 wherein said beam of light flashes in a predetermined sequence, and remains flashing for a predetermined time.

9. The railroad crossing signal apparatus of claim 1 wherein said signal head member includes a lens assembly to focus light into a beam in the direction of an approaching vehicle.

10. The railroad crossing signal apparatus of claim 1 wherein said plurality of signal head members each include a base plate portion embedded in said roadway.

* * * * *